US005829266A

United States Patent [19]

Lyu

[11] Patent Number: 5,829,266

[45] Date of Patent: Nov. 3, 1998

[54] AUTOMATIC ICE MAKER OF A REFRIGERATOR

[75] Inventor: Gang Lyu, Incheon, Rep. of Korea

[73] Assignee: Daewoo Electronics Co., LTD., Rep. of Korea

[21] Appl. No.: 865,707

[22] Filed: May 30, 1997

[30] Foreign Application Priority Data

Aug. 31, 1996 [KR] Rep. of Korea ..... 96-37760

[51] Int. Cl.[6] ..... F25C 1/12

[52] U.S. Cl. ..... 62/353

[58] Field of Search ..... 62/353, 72

[56] References Cited

U.S. PATENT DOCUMENTS

| | | | |
|---|---|---|---|
| 1,894,897 | 1/1933 | Tinkham | 62/72 |
| 2,613,511 | 10/1952 | Walsh | 62/353 |
| 3,330,128 | 7/1967 | Wilson | 62/353 |
| 5,177,980 | 1/1993 | Kawamoto et al. | 62/353 |
| 5,253,487 | 10/1993 | Oike | 62/353 |
| 5,400,605 | 3/1995 | Jeong | 62/72 |
| 5,425,248 | 6/1995 | Trantina | 62/353 |

*Primary Examiner*—William E. Tapolcal

*Attorney, Agent, or Firm*—Cushman Darby & Cushman Intellectual Property Group of Pillsbury Madison & Sutro, LLP

[57] ABSTRACT

Disclosed is an automatic ice maker for effectively separating ice through transmitting the compressive force and the rotational force to the ice tray during the rotation of ice tray. A first rotating shaft is provided at a first end of the ice tray and a second rotating shaft is provided at a second end which is opposite to the first end. A power transmitting member transmits the rotational force to the ice tray through the first rotating shaft and the compressive force along the direction of the first rotating shaft to separate the ice. A supporting member limits the rotation of the ice tray and supports the second rotating shaft. The ice tray is turned over using the rotational force of a step motor. The power transmitting member generates the compressive force to the turned-over ice tray and the compressive force is transmitted to the ice tray to twist the ice tray. Through the twist, the ice is separated from the ice tray.

7 Claims, 4 Drawing Sheets

AUTOMATIC ICE MAKER OF A REFRIGERATOR

BACKGROUND OF THE INVENTION

1. Field of the Invention

The present invention relates to an automatic ice maker, and more particularly, to an automatic ice maker of a refrigerator having an automatic ice separating function of automatically separating ice from an ice tray.

2. Description of the Prior Art

Generally, a refrigerator is provided with an automatic ice maker for repeating the operations of freezing water supplied to an ice tray installed in an ice making compartment by a water feeding apparatus, making ice, separating the ice by rotating and turning over the ice tray by a driving apparatus, storing the ice, supplying water into the ice tray and making ice.

In the refrigerator, a freezing compartment, a refrigerating compartment and the ice making compartment are formed. Air cooled by a cooler is supplied to each room by a fan. In the ice making compartment, the automatic ice maker is disposed. Examples of the automatic ice maker are disclosed in U.S. Pat. No. 5,177,980 (issued to Akira Kawatmoto, et al.) and No. 5,400,605 (issued to Sung-Ki Jeong).

FIG. 1 is a perspective view for showing an embodiment of the conventional automatic ice maker. As illustrated in FIG. 1, a driving section (not shown) is disposed at the front portion of the ice making compartment, and a fixing member 41 which is protruded rearward and has an L-shape is disposed at one end of the rear portion of the driving section. In the driving section, a driving apparatus having a motor, a gear mechanism and an outputting shaft 20, is installed. The driving apparatus reduces the when another part is located within the rotating radius range of ice separating plate 15, the rotation becomes limited. Therefore, it is difficult to design the ice maker.

SUMMARY OF THE INVENTION

Accordingly, it is an object of the present invention considering the above-mentioned defects, to provide an automatic ice maker which can effectively separate ice from an ice tray after making the ice in a refrigerator.

To accomplish the above object, there is provided in the present invention an automatic ice maker of a refrigerator comprising an ice tray for freezing water and forming ice, the ice tray being provided with a first rotating shaft at a first end thereof and a second rotating shaft at a second end thereof which is opposite to the first end, a power transmitting means for transmitting a rotational force to the ice tray through the first rotating shaft and applying a compressive force along a direction of the first rotating shaft to separate the ice, a supporting means for limiting a rotation of the ice tray and supporting the second rotation shaft, and a driving means for providing the rotational force to the power transmitting means.

Preferably, the power transmitting means includes a first cylindrical connecting, member having a first inclined plane, a first-end of the first cylindrical connecting member being connected to the driving means and a second end of the first cylindrical connecting member, which is opposite to the first end, being connected to the first rotating shaft of the ice tray, and a second cylindrical connecting member having a second inclined plane corresponding to the first inclined plane for closely adhering to the first inclined plane, and having a central line which coincides with a central line of the first rotating shaft of the ice tray. At this time, a shaft hole into which the first rotating rotation speed of the motor by the gear mechanism and transmits the reduced rotation to outputting shaft 20.

In fixing member 41, an ice tray 10 is disposed. At the front center portion of ice tray 10, a rotating pin 11 is formed. The front center portion of rotating pin 11 is connected to and supported by outputting shaft 20 which receives the rotational force generated by the motor. In addition, at the rear center portion of ice tray 10, a supporting shaft 13 is formed. Ice tray 10 is rotatably fixed to fixing member 41 through supporting shaft 13. The rotational force generated by the motor is transmitted to outputting shaft 20 through the gear mechanism, and the rotational force is transmitted to ice tray 10 through rotating pin 11. Accordingly, ice tray 10 can be rotated by the rotation of outputting shaft 20.

Ice tray 10 is made from a material such as plastic which can be twisted laterally and ice tray 10 has a hexahedral shape of which upper surface is opened. The inside of ice tray 10 is partitioned into a plurality of concave (recessed) portions for making ice. The cross-section of the side portion of the concave portion has a reverse mesa shape for advantageously removing the ice from ice tray 10. Into ice tray 10, water is supplied by a water feeding apparatus.

At the rear portion of ice tray 10, that is, at one edge portion where supporting shaft 13 is formed, and ice separating plate 15 is formed along the length of ice tray 10. In addition, at one corner portion of fixing member 41, that is, at the corner portion opposite to ice separating plate 15 while centering supporting shaft 13 as a center, a stopper 31 is formed. Stopper 31 makes contact with ice separating plate 15 to limit the rotation of ice tray 10 when ice tray 10 is rotated to separate the ice in ice tray 10 from ice tray 10.

At the lower portion of the ice making compartment and below ice tray 10, an ice reservoir (not shown) is disposed. The separated ice through the rotation of ice tray 10 is stored in the ice reservoir.

FIG. 2 is a schematic diagram for explaining the ice separating process in the conventional automatic ice maker.

in the conventional automatic ice maker illustrated in FIG. 1, when the ice is obtained in the concave portion of ice tray 10, micom (not shown) senses the ice through a temperature sensor (not shown) provided in ice tray 10. When the microcomputer (hereinafter, referred to as "micron") judges that the ice is completely frozen, the micom provides an ice separating signal to the motor for driving the motor. The rotational force of the motor is transmitted to rotating pin 11 through outputting shaft 20 and ice tray 10 rotates to the degree of 180°, as illustrated in FIG. 2. At this time, ice separating plate 15 makes contact with stopper 31 for preventing further rotation of ice tray 10. However, the rotational force of the motor is still transmitted to ice tray 10 through rotating pin 11. Accordingly, the rear portion of ice tray 10 where ice separating plate 15 is formed cannot rotate further than the 180° rotated state. However, the front portion of ice tray 10 to which the rotational force of the motor is transmitted, that is, the portion where rotating pin 11 is formed, rotates further that the 180° rotated state to twist ice tray 10 laterally. Through the twist of ice tray 10, the ice formed in ice tray 10 is separated from ice tray 10 and falls down.

As described above, the conventional automatic ice maker includes the ice separating plate having a plate form or the stopper. However, the ice separating plate and the stopper are easily deformed or destroyed. The ice separating operation cannot be completely performed due to the deformation or the destruction of the parts. In addition, shaft is inserted, is formed at the second end of the first cylindrical connecting member. The second cylindrical connecting member is extrapolated around the first rotating shaft (that is, the first rotation shaft is surrounded by the second cylindrical connecting member) and the first rotating shaft is protruded from the second cylindrical connecting member.

Particularly, the supporting means rotatably supports the second rotating shaft to an inner wall of the refrigerator, the supporting means being provided with a first cylindrical supporting member in which a cross section of a free end portion is formed in a first spiral (or helical) shape for having a first stepped jaw for limiting a rotation of the ice tray, and a second cylindrical supporting member having a second stepped jaw corresponding to the first stepped jaw and having a second spiral shape corresponding to the first spiral shape. At this time, the first cylindrical supporting member includes a shaft hole into which the second rotating shaft is inserted, and the second cylindrical supporting member is extrapolated around the second rotating shaft (that is, the second rotating shaft is surrounded by the second cylindrical supporting member) the second rotating shaft being protruded from the second cylindrical supporting member.

According to the present invention, the rotating force of the step motor is transmitted to the power transmitting member through the driving section. The power transmitting member first provides the rotational force to the ice tray for turning over the ice tray. A compressive force is generated by the power transmitting member and applied to the turned-over (or up-side-down) ice tray to press the ice tray. By the pressing phenomena, the ice is separated from the ice tray.

BRIEF DESCRIPTION OF THE DRAWINGS

The above object and advantages of the present invention will become more apparent by describing in detail preferred embodiments thereof with reference to the attached drawings in which.

DESCRIPTION OF THE PREFERRED EMBODIMENT

Hereinafter, the constituting elements and the operating principles of the automatic ice maker according to the present invention, will be explained in more detail with reference to the accompanying drawings.

Figure 1:
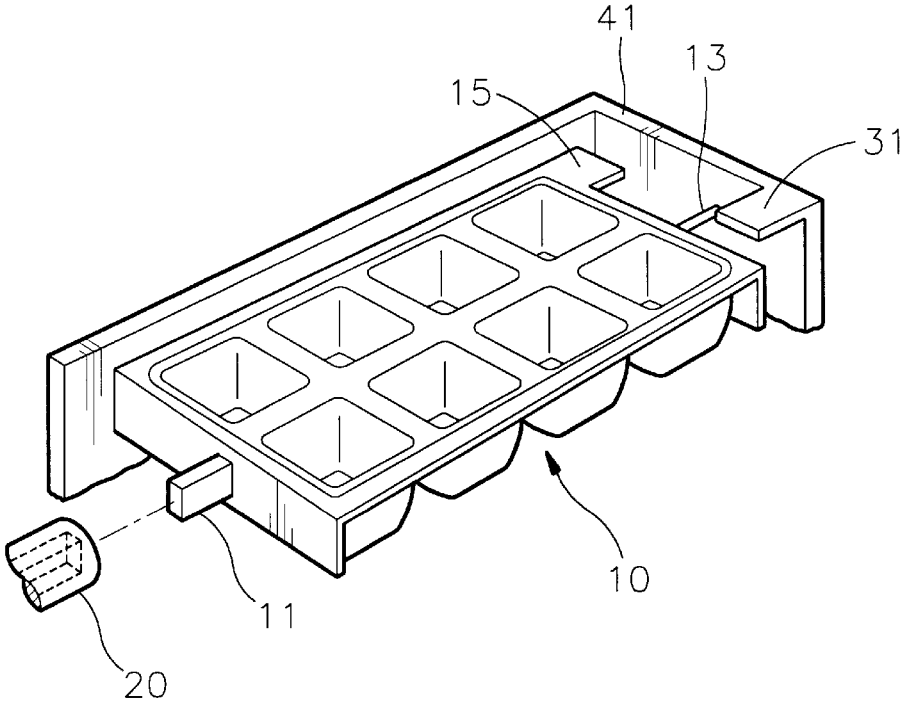
FIG. 1 (PRIOR ART)
FIG. 1 is a perspective view for schematically showing the constitution of the conventional automatic ice maker.
Figure 2:
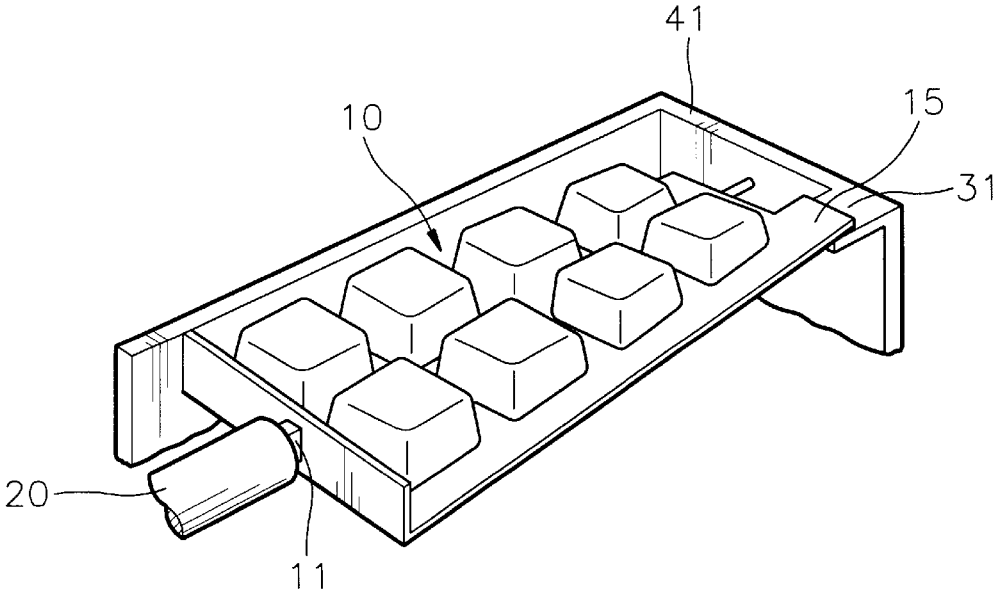
FIG. 2 (PRIOR ART)
FIG. 2 is a perspective view for schematically explaining the ice separating process of the conventional automatic ice maker.
Figure 3:
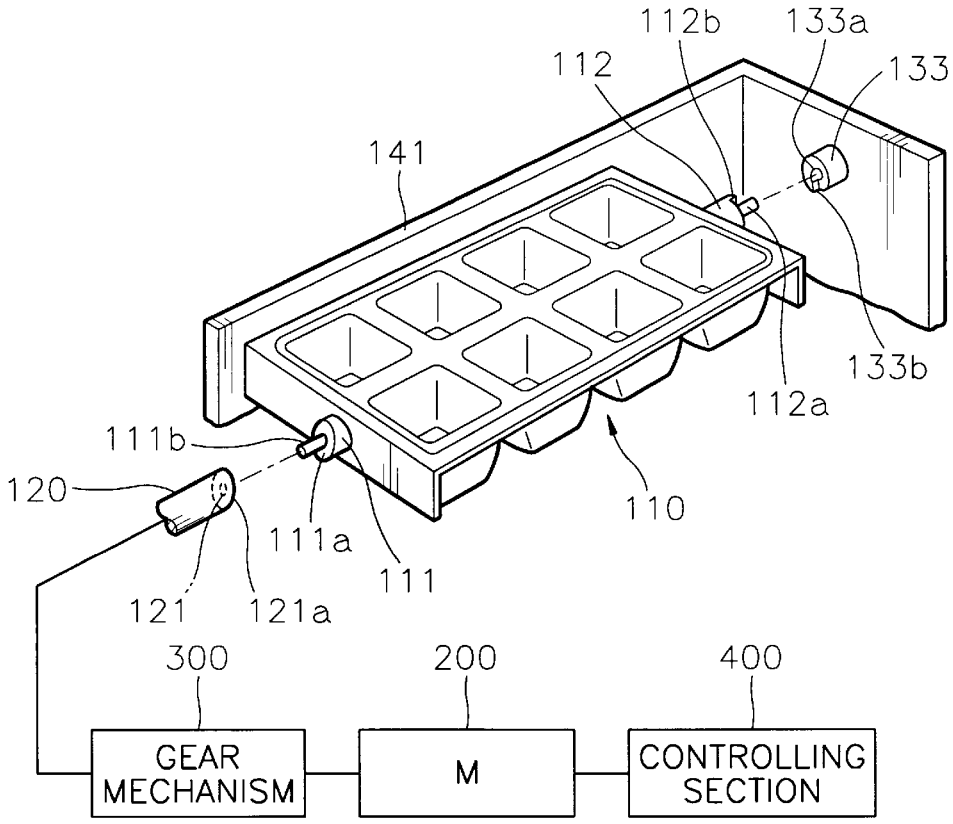
FIG. 3 is a perspective view for showing the constitution of an automatic ice maker according to an embodiment of the present invention.
Figure 4:
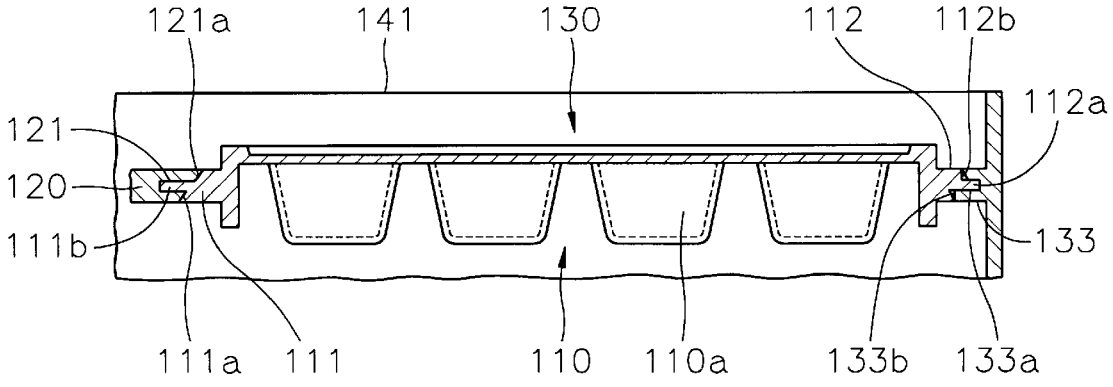
FIG. 4 is a cross-sectional view cut alone the central line of the automatic ice maker illustrated in FIG. 3.

FIG. 3 is a perspective view for showing the constitution of the automatic ice maker according to an embodiment of the present invention, and FIG. 4 is a cross-sectional view cut along the central line of the automatic ice maker illustrated in FIG. 3.

The illustrated automatic ice maker includes a driving section, an ice tray, a power transmitting member and a supporting member.

At the front portion of the ice making compartment of a refrigerator, the driving section is installed and at one rear end portion of the driving section, a fixing member 141 which has an L-shape and is protruded rearward, is installed. The driving section includes a step motor 200 and gear mechanism 300. To gear mechanism 300, an outputting shaft is connected. The driving section reduces the rotation speed of step motor 200 by the gear mechanism and transmits the reduced rotation to the outputting shaft.

In fixing member 141, an ice tray 100 is disposed. A first rotating shaft 111*b* is formed at a first end which is the front portion of ice tray 110, and a second rotating shaft 112*a* is formed at a second end which is opposite to the first end. First rotating shaft 111*b* is connected to the outputting shaft of gear mechanism 300 of the driving section and transmits the rotational force of step motor 200 to ice tray 110.

Ice tray 110 has a plurality of concave (recessed) portions for freezing water to form ice. Ice tray 110 is made from a material such as plastic which can be laterally twisted and ice tray 110 has a hexahedral shape of which upper surface is opened. The inner portion of ice tray 110 is partitioned into a plurality of concave portions for making ice. The cross-section of the side portion of the concave portion has a reverse mesa shape for separating the ice from the ice tray advantageously. Into ice tray 110, water is supplied by an apparatus (not shown) for feeding ice making water.

At the front center portion of ice tray 110, the power transmitting member for firstly transmitting the rotational force to ice tray 110 through first rotating shaft 111*b* and for secondly transmitting a compressive force along the direction of the first rotating shaft to separate the ice, is disposed.

Figure 5:
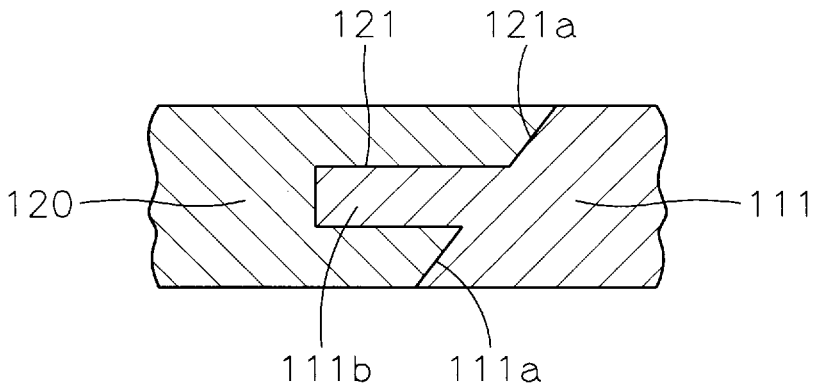
FIG. 5 is a cross-sectional view of the power transmitting member of the automatic ice maker illustrated in FIG. 3.
Figure 6:
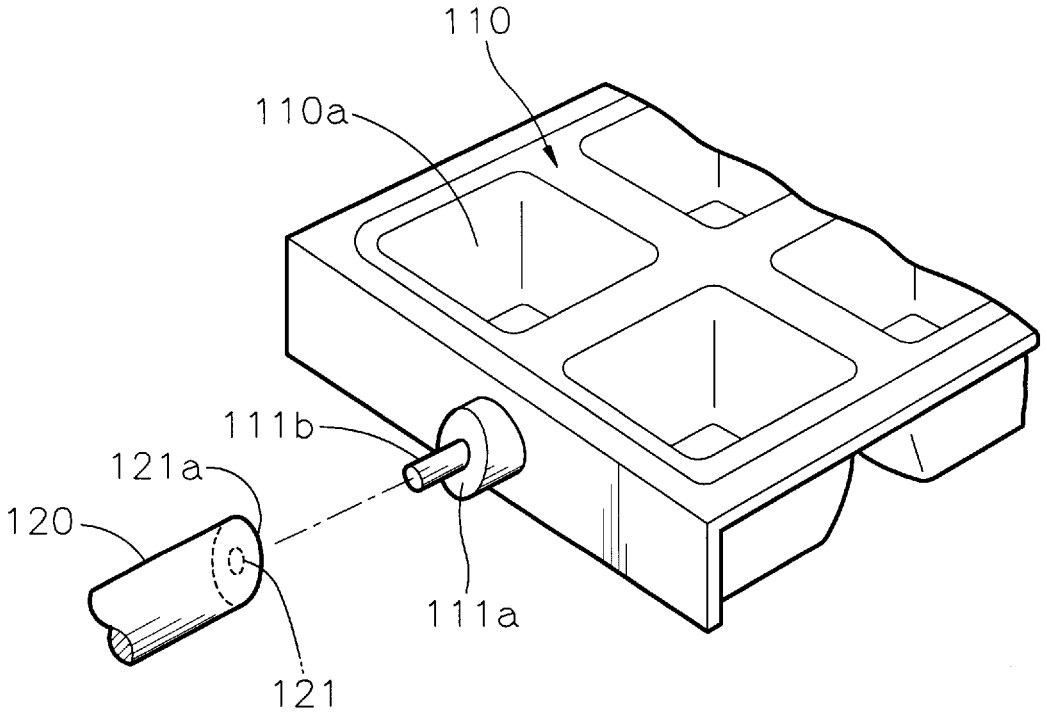
FIG. 6 is a partial perspective view of the power transmitting member illustrated in FIG. 5.

FIG. 5 is a cross-sectional view of the power transmitting member of the automatic ice maker illustrated in FIG. 3, and FIG. 6 is a partial perspective view of the power transmitting member illustrated in FIG. 5.

As illustrated in FIGS. 5 & 6, the power transmitting member includes a first cylindrical connecting member 120 and a second cylindrical connecting member 111. A first end of first cylindrical connecting member 120 is connected to the outputting shaft of gear mechanism, 300 for receiving the rotational force of step motor 200. A second end of the power transmitting member, which is opposite to the first end, is connected to first rotating shaft 111*b* of ice tray 110 and has an elliptical first inclined plane 121*a*. At the second end of first cylindrical connecting member 120, a shaft hole 121 into which first rotating shaft 111*b* is inserted, is formed.

Second cylindrical connecting member 111 has a second inclined plane 111*a* corresponding to first inclined plane 121*a* for adhering closely to first inclined plane 121*a* and had a central line which coincides with the central line of first rotating shaft 111*b* of ice tray 110. Second cylindrical connecting member 111 is extrapolated around the first rotating shaft 111*b* (that is, first rotation shaft 111*b* is surrounded by second cylindrical connecting member 111) and first rotating shaft 111*b* is protruded from second cylindrical connecting member 111.

The rotational force generated from step motor 200 is transmitted to first cylindrical connecting member 120 through the outputting shaft, and the rotational force is again transmitted to first rotating shaft 111*b* of ice tray 110 through second cylindrical connecting member 111. Since first inclined plane 121*a* of first cylindrical connecting member 120 and second inclined plane 111*a* of second cylindrical connecting member 111 adhere closely to each other, the rotational force of first cylindrical connecting member 120 is transmitted to ice tray 110 to thereby rotate ice tray 110.

When second cylindrical connecting member 111 does not rotate, while first cylindrical connecting member 120 rotates, first inclined plane 121*a* and second inclined plane 111*a* generate the horizontal pushing (pressing) force (i.e. lateral (or horizontal) compressive force) and transmit this force to ice tray 110.

Figure 7:
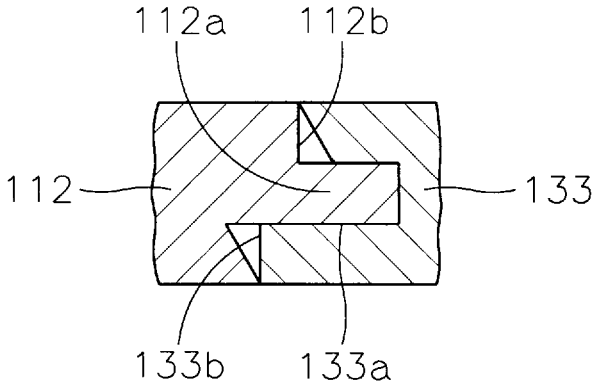
FIG. 7 is a cross-sectional view of the supporting member of the automatic ice maker illustrated in FIG. 3.

The supporting member limits the rotation of ice tray 110 and supports second rotating shaft 112*a*. FIG. 7 is a cross-sectional view of the supporting member of the automatic ice maker illustrated in FIG. 5, and FIG. 8 is a partial perspective view of the supporting member illustrated in FIG. 7.

Figure 8:
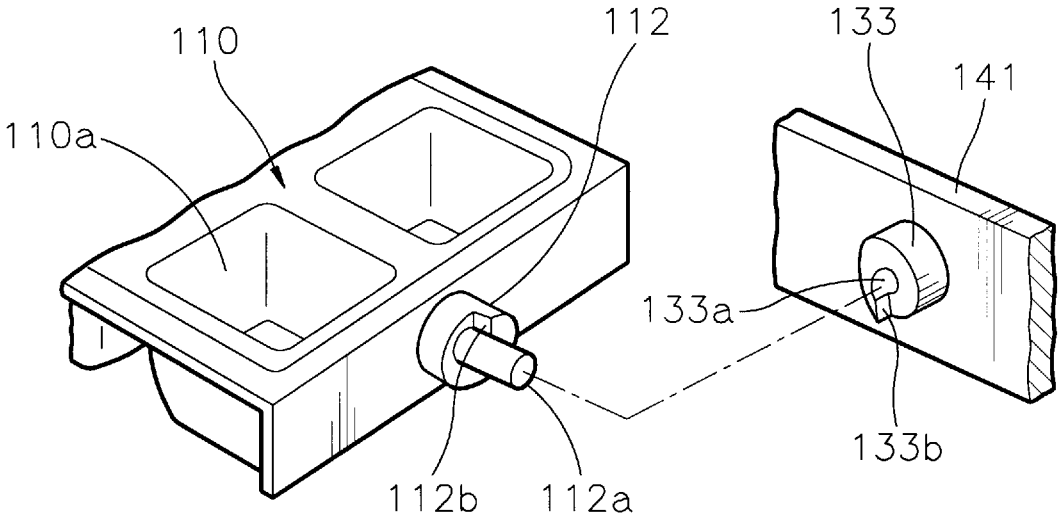
FIG. 8 is a partial perspective view of the supporting member illustrated in FIG. 7.

Referring to FIGS. 7 & 8, the supporting member includes a first cylindrical supporting member 133 and a second cylindrical supporting member 112. First cylindrical supporting member 133 rotatably supports second rotating shaft 112*a* to the inner wall of the refrigerator. The cross section of the free end of first cylindrical supporting member 133 is formed in a first spiral shape so that first cylindrical supporting member 133 has a first stepped jaw 133*b*. Second cylindrical supporting member 112 has a second stepped jaw 112*b* corresponding to first stepped jaw 133*b* and a second spiral shape corresponding to the first spiral shape.

First stepped jaw 133*b* and second stepped jaw 112*b* are positioned symmetrically while centering second rotating shaft 112*a* as a center while freezing water contained in the concave portion. When the rotational force of step motor 200 is transmitted to ice tray 110 through the power transmitting member for separating the ice formed in the concave portions of ice tray 110, ice tray 110 rotates. At the position where ice tray 110 rotates to the degree of 180°, first stepped jaw 133*b* comes into contact with second stepped jaw 112*b* and ice tray 110 cannot be rotated further.

At this time, second cylindrical connecting member 111 does not rotate, while first cylindrical connecting member 120 rotates. Accordingly, first inclines plane 121*a* and second inclined plane 111*a* generate lateral pushing forces (i.e. lateral compressive force). This compressive force is transmitted to ice in the ice tray 110 to separate the ice from ice tray 110.

First cylindrical supporting member 133 has shaft hole 133*a* into which second rotating shaft 112*a* is inserted. Second cylindrical supporting member 112 is extrapolated around second rotating shaft 112*a* (that is, second rotating shaft 112*a* is surrounded by second cylindrical supporting member 112) and second rotating shaft 112*a* is protruded from second cylindrical supporting member 112.

First stepped jaw 133*b* comes into contact with second stepped jaw 112*b* to limit the rotation of ice tray 110 when ice tray 110 rotates for separating the ice from ice tray 110.

An ice reservoir (not shown) is disposed at the bottom portion of the ice making compartment, under ice tray 110. The ice separated through the rotation of ice tray 110 is stored in the ice reservoir.

The operation of the automatic ice maker as described above, will be explained below, in detail.

At the state illustrated in FIG. 3, water is supplied to the concave portions of ice tray 110 through the water feeding apparatus. Second rotating shaft 112*a* of ice tray 110 is rotatably inserted in shaft hole 133*a* of first cylindrical supporting member 133 which is fixed to the inner surface of L-shaped fixing member 141 which is fixed to the inner wall of the refrigerator. In addition, first rotating shaft 111*b* of ice tray 110 is inserted into shaft hole 121 of first cylindrical connecting member 120.

At this time, second stepped jaw 112*b* of the spiral cross section of second rotating shaft 112*a* is positioned at the upper portion and first stepped jaw 133*b* of first cylindrical supporting member 133 is positioned at the lower portion. (Alternatively, they could be positioned at the contrary positions. In this case, first stepped jaw 133*b* and second stepped jaw 112*b* should be symmetrically positioned while centering second rotating shaft 112*a* as a center.) In addition, second inclined plane 111*a* of second cylindrical connecting member 111 closely make contact with first inclined plane 121*a* of first cylindrical connecting member 120.

When the ice is formed, a micom (not shown) senses the ice through a temperature sensor (not shown) provided in ice tray 110. When the micom judges that the ice is completely frozen, micom provides an ice separating signal through a controlling section 400 to step motor 200 to drive step motor 200.

The rotational force of step motor 200 is transmitted to first cylindrical connecting member 120 through the driving section. At this time, first cylindrical member 120 and first rotating shaft 111*b* are idling. However, second inclined plane 111*a* of second cylindrical connecting member 111 closely makes contact with first inclined plane 121*a* of first cylindrical connecting member 120. Therefore, the rotational force of second cylindrical connecting member 111 is transmitted to first rotating shaft 111*b* to rotate ice tray 110.

When ice tray 110 rotates to the degree of 180°, first stepped jaw of first supporting member 133 and second stepped jaw 112*b* of second supporting member 112 meet each other so that ice tray 110 cannot be rotated further. At this time, ice tray 110 is in the state of being turned-over to the degree of 180°.

However, controlling section 400 controls step motor 200 for continuing the rotation. Then, ice tray 110 keeps the turned-over state by first stepped jaw 133*b* of first supporting member 133 and second stepped jaw 112*b* of second supporting member 112. Second inclined plane 111*a* of second cylindrical connecting member 111 and first inclined plane 121*a* of first cylindrical connecting member 120 make a hysterisis, and parts of them make contact to generate the compressive force. This compressive force is transmitted to ice tray 110. That is, the rotating movement of step motor 200 is transformed into a linear movement by second inclined plane 111*a* of second cylindrical connecting member 111 and first inclined plane 121*a* of first cylindrical connecting member 120.

Accordingly, turned-over ice tray 110 to the degree of 180° receives the lateral compressive force and is twisted. Through the twist, ice formed in ice tray 110 moves to make a space between ice tray 110 and the ice. As a result, ice is separated from ice tray 110.

The separated ice falls into the ice reservoir disposed under ice tray 110 and is stored.

According to the present invention, the rotational force of the step motor is transmitted to the power transmitting member. The power transmitting member firstly transmits the rotational force to the ice tray to turn over the ice tray to the degree of 180°. The turned-over ice tray cannot rotate further. At this time, the step motor continues the rotation and the power transmitting member generates the compressive force to transmit to the ice tray. Accordingly, the ice tray receives the lateral compressive force and is twisted. Through the twist, the ice in the ice tray moves to make a space between the ice tray and the ice. Then the ice is separated from the ice tray.

In the automatic ice maker of the present invention, the power transmitting apparatus for providing the rotational force and the lateral compressive force to the rotating shaft, is formed. The manufacturing of the ice maker is advantageous and the space used for designing thereof is reduced to increase a free space. In addition, the supporting member for limiting the rotation of the ice tray if formed around the fixing shaft to increase a firmness.

Although the preferred embodiments of the invention has been described, it is understood that the present invention should not be limited to the preferred embodiment, but various changes and modifications can be made by one skilled in the art within the spirit and scope of the invention as hereinafter claimed.

What is claimed is:

1. An automatic ice maker of a refrigerator comprising:

an ice tray for freezing water and forming ice, said ice tray being provided with a first rotating shaft at a first end thereof and a second rotating shaft at a second end thereof which is opposite to the first end;

a power transmitting means for transmitting a rotational force to said ice tray through said first rotating shaft and transmitting a compressive force along a direction of said first rotating shaft to separate the ice;

a supporting means for limiting a rotation of said ice tray and supporting said second rotating shaft; and a driving means for providing the rotational force to said power transmitting means, wherein said power transmitting means includes a first cylindrical connecting member having a first inclined plane, a first end of said first cylindrical connecting member being connected to said driving means and a second end of said first cylindrical connecting member, which is opposite to the first end, being connected to a first rotating shaft of said ice tray, and a second cylindrical connecting member having a second inclined plane corresponding to the first inclined plane for closely adhering to the first inclined plane and having a central line which coincides with a central line of said first rotating shaft of said ice tray.

2. An automatic ice maker of a refrigerator as claimed in claim 1, wherein a shaft hole to which said first rotating shaft is inserted, is formed at said second end of said first cylindrical connecting member.

3. An automatic ice maker of a refrigerator as claimed in claim 1, wherein said second cylindrical connecting member is extrapolated around said first rotating shaft and said first rotating shaft is protruded from said second cylindrical connecting member.

4. An automatic ice maker of a refrigerator as claimed in claim 1, wherein said power transmitting means transmits the rotational force to said ice tray to turn over said ice tray, and transmits the lateral compressive force in said turned-over ice tray to separate said ice from said ice tray.

5. An automatic ice maker of a refrigerator, comprising:

an ice tray for freezing water and forming ice, said ice tray being provided with a first rotating shaft at a first end thereof and a second rotating shaft at a second end thereof which is opposite to the first end:

a power transmitting means for transmitting a rotational force to said ice tray through said first rotating shaft and transmitting a compressive force along a direction of said first rotating shaft to separate the ice;

a supporting means for limiting a rotation of said ice tray and supporting said second rotating shaft; and a driving means for providing the rotational force to said power transmitting means, wherein said supporting means rotatably supports said second rotation shaft to an inner wall of the refrigerator, said supporting means being provided with a first cylindrical supporting member in which a cross-section of a free end portion is formed in a first spiral shape for having a first stepped jaw for limiting a rotation of said ice tray and a second cylindrical supporting member having a second stepped jaw corresponding to said first stepped jaw and having a second spiral shape corresponding to said first spiral shape.

6. An automatic ice maker of a refrigerator as claimed in claim 5, wherein said second stepped jaw is formed at a position symmetric to said second stepped jaw while centering second rotating shaft as a center.

7. An automatic ice maker of a refrigerator as claimed in claim 5, wherein said first cylindrical member includes a shaft hole to which said second rotating shaft is inserted and said second cylindrical supporting member is extrapolated around said second rotating shaft, said second rotating shaft being protruded from said second cylindrical supporting member.

* * * * *